US005562233A

United States Patent [19]

Glasa

[11] Patent Number: 5,562,233

[45] Date of Patent: Oct. 8, 1996

[54] INDICATOR FOR A DEVICE FOR THE INFLATION OF A CONTAINER OR A FLOATING BODY OF AN ITEM OF LIFESAVING EQUIPMENT

[75] Inventor: Stefan Glasa, Hamburg, Germany

[73] Assignee: Bernhardt Apparatebau GmbH u. Co., Germany

[21] Appl. No.: 104,833

[22] Filed: Aug. 10, 1993

[30] Foreign Application Priority Data

Aug. 13, 1992 [DE] Germany ..... 9210849 U

[51] Int. Cl.[6] ..... B67B 7/24

[52] U.S. Cl. ..... 222/5; 222/23; 222/41; 441/94

[58] Field of Search ..... 222/3, 5, 23, 41, 222/394; 441/92–95

[56] References Cited

U.S. PATENT DOCUMENTS

| | | | |
|---|---|---|---|
| 2,548,750 | 4/1951 | Stroop | 222/23 X |
| 2,613,848 | 10/1952 | Wood | 222/23 X |
| 2,752,615 | 7/1956 | Parker . | |
| 2,894,658 | 7/1959 | Spidy . | |
| 3,630,413 | 12/1971 | Beckes . | |
| 3,675,722 | 7/1972 | Balmes, Sr. | 222/23 X |
| 3,890,662 | 6/1975 | Roberts . | |
| 4,484,695 | 11/1984 | Fallon et al. | 222/23 |
| 4,946,067 | 8/1990 | Kelsall | 222/23 X |
| 4,957,220 | 9/1990 | Du | 222/23 X |
| 4,972,971 | 11/1990 | Janko et al. | 222/23 X |
| 5,370,567 | 12/1994 | Glasa | 441/94 X |
| 5,400,922 | 3/1995 | Weinheimer et al. | 222/5 |
| 5,413,247 | 5/1995 | Glasa | 222/5 |
| 5,429,539 | 7/1995 | Glasa | 222/5 X |

FOREIGN PATENT DOCUMENTS

| | | |
|---|---|---|
| 0274452 | 7/1988 | European Pat. Off. . |
| 0535299A1 | 4/1992 | European Pat. Off. . |
| 345273 | 11/1904 | France . |
| 2263004 | 10/1975 | France . |
| 2267928 | 11/1975 | France . |
| 2432629 | 2/1980 | France . |
| 1201140 | 9/1965 | Germany . |
| 2418433 | 8/1976 | Germany . |
| 9112117.5 | 1/1992 | Germany . |
| 9113897.3 | 4/1993 | Germany . |
| 9113940.6 | 4/1993 | Germany . |
| 9114026.9 | 4/1993 | Germany . |
| 64953 | 6/1993 | Germany . |
| 93112947.2 | 12/1993 | Germany . |
| 728415 | 4/1955 | United Kingdom . |
| 1533879 | 11/1978 | United Kingdom . |
| PCT/US82/00731 | 12/1992 | WIPO . |

*Primary Examiner*—Kevin P. Shaver
*Attorney, Agent, or Firm*—Kelly, Bauersfeld & Lowry

[57] ABSTRACT

A device as provided for the inflation of a container or a floating body of an item of lifesaving equipment with compressed gas. A compressed gas container sealed with the aid of a diaphragm is provided which, within the region of the container neck, possesses an external thread that can be screwed into a receiving aperture in a housing which is provided with a corresponding internal thread. The gas content of the container is released by opening the diaphragm with the aid of an opening striker disposed in the housing, which can be moved against the diaphragm by a hand lever and/or by the force of a spring. An indicating part indicates the screwing-in state of the compressed gas container, i.e., whether the compressed gas container is screwed-in so far into the receiving aperture that reliable operation of the device is guaranteed. The indicating part is displaced by the compressed gas container as it is screwed into the receiving aperture of the housing, from an initial position, and is supported by a spring element on the housing against a displacement from the initial position.

15 Claims, 3 Drawing Sheets

INDICATOR FOR A DEVICE FOR THE INFLATION OF A CONTAINER OR A FLOATING BODY OF AN ITEM OF LIFESAVING EQUIPMENT

BACKGROUND OF THE INVENTION

The present invention relates to a device for the inflation of a container or a floating body of an item of lifesaving equipment with compressed gas. The compressed gas is provided by a diaphragm-sealed compressed gas container which, within the region of the container neck, is provided with an external thread that can be screwed into a receiving aperture in a housing of the device which is provided with a corresponding internal thread. The gas content of the compressed gas container is released by opening the diaphragm by means of an opening striker disposed in the housing, which can be moved both by means of a hand lever and/or by the force of a spring against the diaphragm.

An automatic device is already known which includes a basic body into which the compressed gas bottle is screwed, and a second, separate part in which a spring element is disposed that is tensioned by being screwed-in or by being fitted together to produce the requisite momentum in order to, in a known manner, by the interposition of a tablet that dissolves in water, thrust a pointed striker through the sealing diaphragm for opening the compressed gas bottle (DE-AS 27 15 132). In this case the compressed gas bottle has to be screwed-in completely while possessing a certain pretension in order to make the device operate perfectly.

In devices of the type pertaining to the present invention, vibrations or frictional influences due to external effects must not be detrimental to the compressed gas bottle in its screwed connection with the equipment body since the possibility of a detachment and, with this, an impairment of the reliability could arise. Also, other manually operated and/or automatic devices undesirably require that the compressed gas container be screwed-in at least up to a planned point at which an adequate screwing-in depth and an adequate pretension is ensured, to obtain faultless operation and optimal reliability. Especially in devices of the type mentioned here in which the compressed gas container pretensions the spring which moves the opening striker when the container is screwed into the receiving aperture of the housing, it is of great importance to ensure that the compressed gas container is screwed sufficiently far into the receiving aperture so that not only a more secure fit of the compressed gas container is ensured, but also a sealing of the compressed gas container and an adequate pretensioning of the main spring is achieved.

Accordingly, there exists a need for a device of the type stated which provides indicating means to indicate the screwed-in state of the compressed gas container, i.e., which provides an indication as to whether the compressed gas container is screwed-in far enough into the receiving aperture so that a reliable operation of the device is guaranteed. The present invention fulfills this need and provides other related advantages.

SUMMARY OF THE INVENTION

In a device for inflating a container or a floating body of an item of lifesaving equipment, an indicating part provides means for indicating the screwed-in state of a compressed gas container. The indicating part is displaced from an initial position during the screwing-in of the compressed gas container to bring about an indication which shows the operator that the compressed gas container is screwed-in far enough. The indicating part also tends to ensure that the compressed gas container is screwed-in with an adequate torque since the torque on the gas container, when impinging upon a pertinently constructed fixed or spring-loaded stop, is increased correspondingly so that a reliable fit of the compressed gas container combined with an appropriately far screwing-in is ensured.

The indicating part furthermore ensures that if the device is designed in such a way that the main spring is pretensioned by the compressed gas container, an adequate pretension is applied which guarantees a reliable functioning of the device. It is immaterial in this case whether, when the container is screwed in, a compression spring is compressed or a tension spring is drawn apart. What is essential is that the screwed-in state signalled by the indicating part ensures that the pretension in the main spring suffices.

A further advantage realized by requiring the gas container to be screwed into the receiving aperture before the indication takes place by the indicating part, is that the diaphragm of the compressed gas container is placed sufficiently close to the spike or the point of the opening striker so that the latter, when triggered, is certain to reach the diaphragm. In this connection the indicating part, when being displaced from its initial position into its terminal position, will, in said position, appear on the housing surface so as to signal the achieved adequate screwed-in state to the user.

By preference it is provided that, in the housing, a perforation extending from the housing exterior to the indicating part is constructed in the form of a viewing window thus making a view of the external casing surface of the indicating part possible. It is preferably provided in this case that the external or casing surface of the indicating part possesses a first subsurface which, in any form whatever, constitutes a marking. A certain contouring of the surface may be provided in this connection, for instance, a knurling or a wavy contour. It is advantageous, however, to apply a coating of paint, e.g., in the form of a coat of red paint, which signals that the device is not adequately screwed-in as yet. It is furthermore provided that a second subsurface of the external or casing surface likewise possesses an appropriate surface configuration in the form of a contouring and/or a coat of paint in the manner explained in the foregoing, in which case a green coat of paint may signal that an adequate screwed-in state exists. Provision is made in this case for the first subsurface to be located in the initial position of the indicating part within the viewing window so that it is signalled to the user that the compressed gas container is not as yet screwed-in at all or is not yet screwed into an adequate screwing-in depth. It can also be provided that the subsurface, in this state, projects from the housing through an appropriate housing aperture and thus signals a state of danger. It is then provided that, when the indicating part is moved, by the screwing-in of the compressed gas container into its terminal position or at least into a position that corresponds to an adequate screwing-in depth of the indicating part, the second subsurface is located in front of the viewing window or in some other way manifests itself to the outside so as to signal to the user that an adequate or the desired screwing-in depth of the compressed gas container has now been reached. In this state, when the green area signals the adequate screwed-in state through the viewing window, an adequate screwing-in moment has been applied ensuring a secure mounting of the compressed gas container and, moreover, an adequate screwing-in depth has also been reached. In an automatic device in which the primary spring is tensined with the aid of the screwing-in operation, an adequate pretensioning of the primary or working spring has then also been achieved in this state.

In this case it is advantageously provided for the indicating part to be supported by a spring element against a displacement from the initial position. On the one hand, this leads to ensuring that the screwing-in moment is increased during the screwing-in operation. It is also ensured that the indicating part, when the compressed gas container is unscrewed once more from the device, again moves automatically and immediately back into its initial position, in which it signals the state of danger connected with an inadequate screwed-in state. The spring element can in this case be realized in different ways. The employment of one or of a plurality of individual springs is just as conceivable here as is the advantageous conception of the spring element being a helical spring inserted into an annular groove constructed concentrically relative to the central longitudinal axis, or that the spring is a spring ring disposed in an annular groove constructed concentrically relative to the central longitudinal axis. The spring ring may in this case be comprised of a deformable plastic or it can be a vulcanized corrugated spring ring or washer. On this occasion the use of rubber, caoutchouc or the like is also possible.

The spring parameter of the spring element is selected in such a way that an adequate displacement path of the indicating part is ensured. It is advantageously provided in this case that the perforation possesses a substantially rectangular configuration and that the cross-section of the perforation has a height in the direction of the central longitudinal axis which corresponds to approximately half of the displacement path of the indicating part from its initial position into its terminal position. The perforation is here disposed in such a way that the second subsurface of the external or casing surface of the indicating part only is displaced entering the viewing area into the region of the perforation when the indicating part has already covered at least 50% of its displacement path, since it is ensured then that the compressed gas container is screwed-in sufficiently deeply and that an adequate torque has also been applied. As soon as the second subsurface, to be designated as indicator strip, then appears in the viewing window, it is ensured that the device is adequately operative.

It can be provided here that, when the compressed gas container is screwed in, the indicating part is acted upon on a front side of the compressed gas container by the front-end rim of the compressed gas container which surrounds the diaphragm and is displaceable for at least a part of the screwing-in path of the compressed gas container in the screwing-in direction.

If provision is made on the device for the receiving aperture of the housing to be constructed in a displacement part and that, during a screwing-in and tensioning operation a housing surface located within the housing aperture can be acted upon by the compressed gas container by means of the front-end rim of the compressed gas container surrounding the diaphragm and the displacement part projects from the housing by at least a part of the screwing-in path of the compressed gas container contrary to the screwing-in direction, that during the screwing-in of the compressed gas container the indicating part, on its front side, can be acted upon by the compressed gas container by means of the front-end rim of the compressed gas container surrounding the diaphragm. The indicating part is thus displaceable by at least a part of the screwing-in path of the compressed gas container in the screwing-in direction, while, in this case, a relatively rigid spring element is then selected and also the dimensioning of the spring element and of the viewing window are selected in such a way that only a small displacement in the housing has to be provided in order not to unnecessarily extend the entire screwing-in path.

It can generally be provided that, during a screwing-in operation and a tensioning operation possibly effected at the same time, the indicating part is acted upon by a ring, lug, cam or surface area of the compressed gas container and that it is displaceable by at least a part of the screwing-in path of the compressed gas container in the screwing-in direction. What is essential in this connection is that the displacement of the indicating part is brought about directly or indirectly by the compressed gas container to ensure at all times that the compressed gas container is screwed-in sufficiently far.

Other features and advantages of the present invention will become apparent from the following more detailed description, taken in conjunction with the accompanying drawings which illustrate, by way of example, the principles of the invention.

BRIEF DESCRIPTION OF THE DRAWINGS

Embodiment examples of the invention are described in greater detail below with the aid of the drawings. Thus

DETAILED DESCRIPTION OF THE PREFERRED EMBODIMENTS

Figure 1:
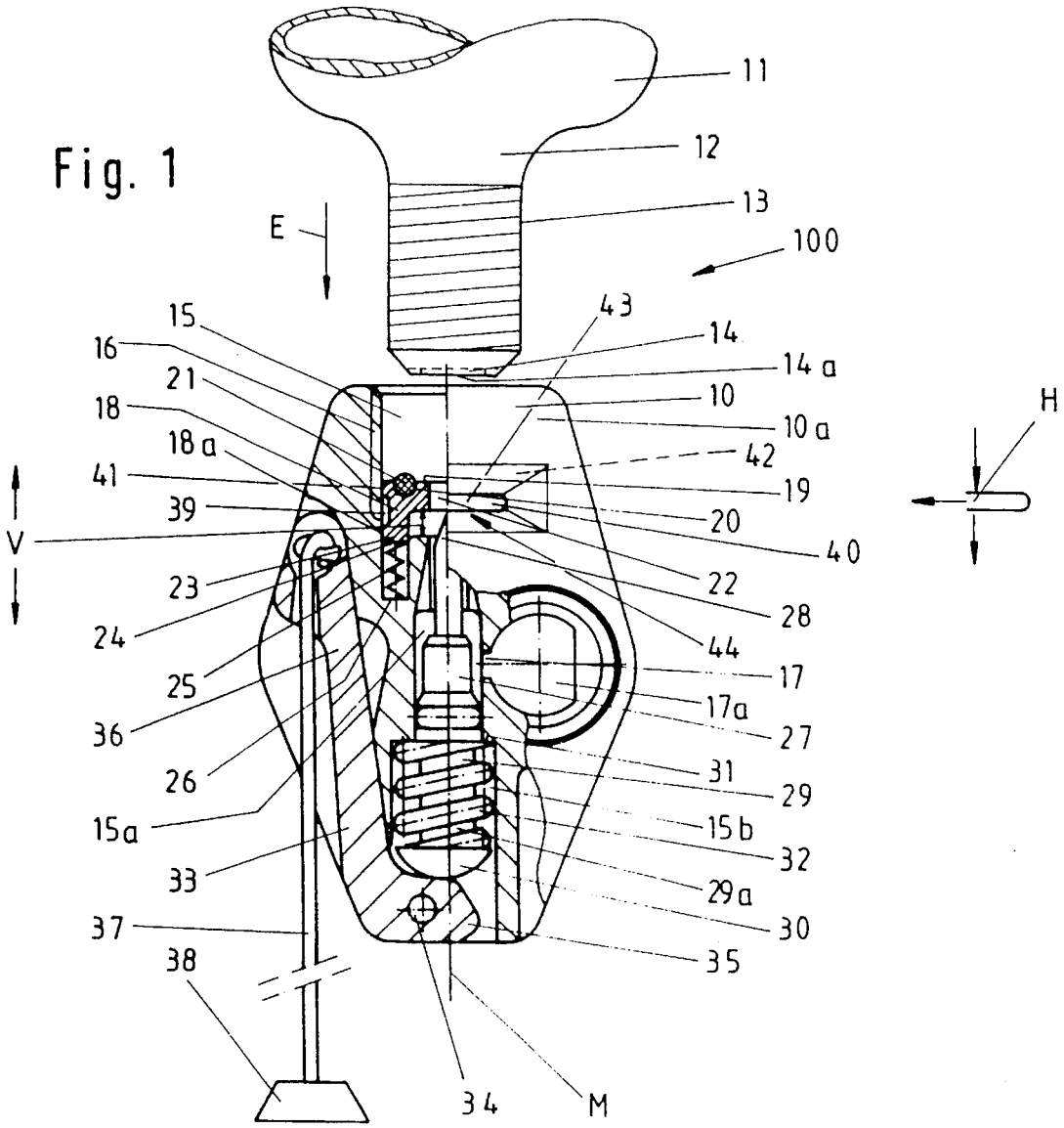
FIG. 1 shows, in a vertical and partially sectioned illustration, an inflation device.

As shown in the drawings for purposes of illustration, the present invention concerns a device for the inflation of a floating body of an item of lifesaving equipment with compressed gas, generally designated in FIG. 1 by the reference number 100. The device 100 there shown is in the non-tensioned state with the compressed gas container 11 being depicted not screwed into the housing 10. The compressed gas container 11, which is constructed in the form of a compressed gas bottle, is, within the region of the container neck 12, provided with an external thread 13 and sealed with the aid of a diaphragm 14.

In a housing bore 15 which, in its upper section, is provided with an internal thread 16 and which can be caused to communicate, via a branch duct 17 and an air supply connection piece indicated at 17*a*, with an item of lifesaving equipment to be inflated (not shown), the indicating part 18 is disposed. The indicating part 18 is constructed in the form of a sleeve and extends, with one of its front sides, as far as into the region of the upper section of the housing bore 15 with the internal thread 16 and which, consequently, when the compressed gas container 11 is screwed in, is acted upon by the front side 14*a* of the container neck 12. Within the region of the front-side 19, an annular groove 20 is constructed into which a sealing ring 21 is inserted which is acted upon directly by the front-side 14*a* of the container neck 15 and, when the compressed gas container 11 is screwed in, results in a sealing so that the gas flowing forth from the perforated diaphragm 14 is able to flow only through the perforation 22 in the sleeve 18 and is, within the housing bore 15, conducted to the branch duct 17. At the oppositely located end 23 of the indicating part 18, the same is supported with the front face 24 upon a spring element which, in this embodiment, is a helical spring 25 which is fitted into an annular groove 26. In the part located on the right-hand side of the drawing and not depicted therein of the housing bore 15, a pertinent retaining means is provided, with the aid of which the indicating part 18 is undetachably retained in the housing 10.

In a further section 15*a* of the housing bore 15, opposite the indicating part 18, the opening striker 27 is displaceably mounted, which, in its normal position, reaches with the spike 28 as far as into the region of the front side 19 of the indicating part 18 and which, by means of its actuating end 29, can be inserted through the perforation 22 and, when the compressed gas container 11 is screwed in, through the diaphragm 14. At its lower section 29*a*, the actuating end 29 possesses a terminal section 30 which, in comparison with the diameter of the cylindrical actuating arm 29, is enlarged and has a hood or cap-shaped configuration. Between the latter and the housing shoulder 31, the return spring 32 is supportingly disposed at both ends. This return spring 32, disposed in the enlarged perforation section 15*b* of the housing perforation 15, holds back the opening striker 27 so that no unintentional damage to the diaphragm 14 can be caused. Underneath the terminal section 30, the hand lever 33 is disposed so as to be swivelable about the axis 34 which is integral with the housing and disposed at a distance from the central longitudinal axis M, said hand lever being constructed in a two-armed fashion. The one swivel arm 35, when swiveled about the axis of rotation 34, actuates the terminal section 30 and displaces the same coaxially to the central longitudinal axis M of the device in the direction of the compressed gas container so that, by means of the spike 28, the diaphragm 14 is perforated, for which a traction strap 37 with a handle 38 is attached to the second swiveling arm 36 of the hand lever 33. Since the arms 35, 36 of the hand lever 33 possess a suitable angle relative to each other and, owing to the great length of the swivel arm 36 in comparison with the stub arm 35, suitable lever conditions also exist when the traction strap 37 is actuated. It is possible for the hand lever 33 to be swiveled without any substantial expenditure of force counterclockwise about the axis of rotation 34 so that the diaphragm is perforated and the compressed gas flows in.

In order to ensure the reliability of this operation, the following is provided in the device 100 according to the invention.

The indicating part 18, on its external casing surface 18*a*, possesses a first annular subsurface 39 which, by way of example, is provided with a coat of red paint 40 in the form of a surface coating. This first subsurface 39 is located within the lower region of the casing surface 18*a* of the indicating part 18 which faces the end 23. Above the first subsurface 39, a second annular subsurface 41 provided with a coat of green paint 42 is formed. In addition, in the housing 10, a perforation 43 is constructed which extends from the housing exterior 10*a* up to the indicating part 18 and forms a viewing window 44 which is disposed in such a way that, through the viewing window 44, the first subsurface 39 can be seen at least in part when the indicating part 18 is in its initial position depicted in the drawing.

When the compressed gas container 11 is now screwed into the housing bore 15, the front-end rim 14*a* of the compressed gas container 11 acts upon the indicating part 18 within the region of the seal 21 and displaces the same against the action of the spring 25 in the direction of screwing-in E. Under the compression of the spring 25, which results in an increase of the screwing-in moment, the second subsurface 41 is displaced downwardly in the process and thus enters slowly into the region of the viewing window 44. The dimensioning in this case is effected in such a way that the second subsurface 41 becomes visible only at that instant when the compressed gas container 11 is screwed-in so far that: (1) an adequate screwing-in depth is ensured; (2) the torque, owing to the spring force of the spring 25 and the compressed seal 21, possesses an adequate value in order to guarantee a reliable mounting of the compressed gas container 11; and (3) the diaphragm 14 has reached the proximity of the spike 28.

In a further screwing-in, the second subsurface 41 then enters fully into the region of the viewing window 41 so that, by virtue of the green coloration 42, it is indicated to the user that the compressed gas container 11 is correctly positioned and screwed-in with the correct torque. Later the indicator indicates further that the compressed gas container 11 has not become detached owing to vibrations.

Figure 2:
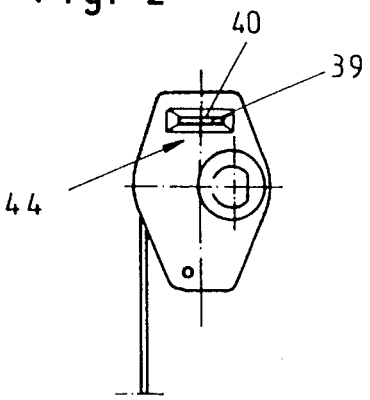
FIG. 2 shows, in a—compared with FIG. 1—reduced illustration, the device according to FIG. 1 in a non-sectioned view.
Figure 3:
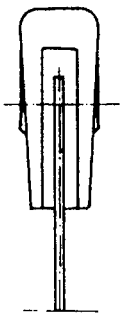
FIG. 3 shows a view of the device according to FIG. 1 which, in comparison with FIG. 1, is turned through 90 degrees.

When the user of such a device wishes to control the same and a compressed gas container 11 is not screwed-in as is shown in FIGS. 2 and 3, then the first subsurface 39 shows through the viewing window 44 which, due to the coat of red paint 40, signals a state of danger.

The viewing window 44 possesses an approximately rectangular shape, the longitudinal side being aligned approximately at right angles to the central longitudinal axis M. It is provided in this case that the cross-section of the perforation has a height H in the direction of the central longitudinal axis M which corresponds to approximately half of the displacement path V of the indicating part 18 from its initial position depicted in FIG. 1 to its terminal position. The perforation is in this case disposed in such a way that the second subsurface 41 is displaced so as to enter into the viewing area of the viewing window only when the indicating part 18 has already covered approximately 50% of its displacement path V. It is then ensured that the desired torque and the desired screwing-in depth have been reached.

Figure 4:
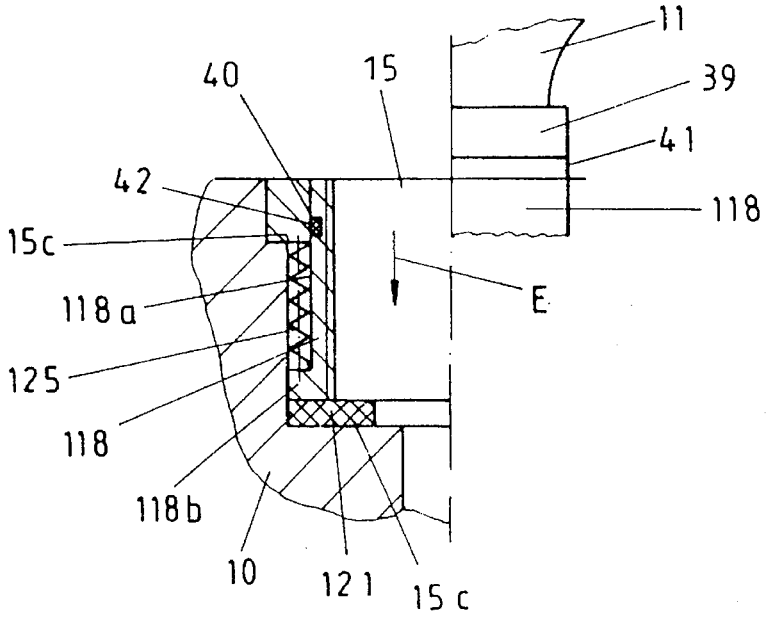
FIG. 4 shows, in a vertical partially sectioned representation, a further embodiment of the device.

In the embodiment depicted in FIG. 4 it is provided that the receiving aperture 15 is constructed within the housing 10 in a displacement part which, according to the invention, constitutes the indicating part 118 at the same time. In this case the peculiarity consists in that, in a screwing-in and tensioning operation, the compressed gas container 11 is screwed-in and, with its front side, acts upon a housing surface 15*c* located within the housing aperture or bore 15, upon which a seal 121 is disposed and, in a further screwing-in of the compressed gas container 11, the displacement part is moved out from the housing 10 by at least a part of the screwing-in path of the compressed gas container 11 contrary to the screwing-in direction, as is illustrated in the right-hand portion of the FIG. 4, only a schematic partial depiction having been effected here.

In this case that the indicating part 118, on its external casing side 118*a*, has a first annular subsurface 39 which is provided with a coat of red paint 40 as a surface coating. This first subsurface 39 is to be found on the upper end of the casing surface 118*a* of the indicating part 18 and facing the compressed gas container 11. Below this first subsurface 39, a second annular subsurface 41 is constructed which is comprised of an inserted ring green in color.

When the compressed gas container 11 is now screwed into the housing aperture 15, the front-end rim of the compressed gas container 11 acts upon the seal 121 and the indicating part 118 is displaced against the action of the spring 125 contrary to the direction of screwing-in E. Initially, the first red subsurface 39 of the indicating part 118 appears on the housing surface, and only once an adequate screwing-in state is reached, the second subsurface 41 becomes visible, as is illustrated in the right-hand portion of FIG. 4.

Figure 5:
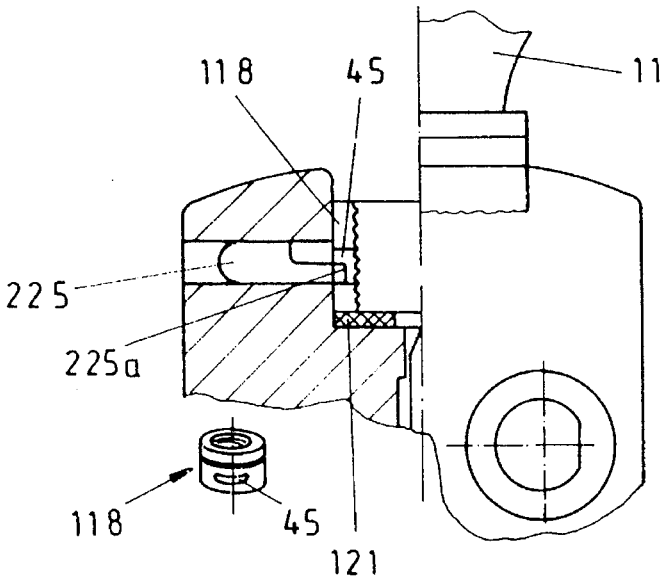
FIG. 5 shows, in a vertical partially sectioned representation, a further embodiment of the device.
Figure 6:
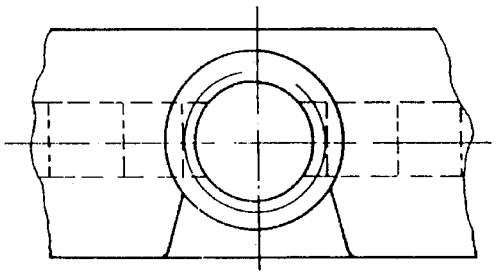
FIG. 6 shows, in a view from the top, the device according to FIG. 5.

Whereas in the embodiment of FIG. 4, the spring 132 is clamped between an outwardly directed flange 118*b* of the indicating part 118 and a housing stop 15*d*, in the embodiment of FIGS. 5 and 6 it is provided that the indicating part 218 has an engagement perforation 45 into which an arm 225*a* of a spring 225 mounted in the housing engages. The operation corresponds to the embodiment shown in FIG. 4 since the same motional process appears when the front-end rim of the compressed gas container 11 impinges upon the seal 121.

Figure 7:
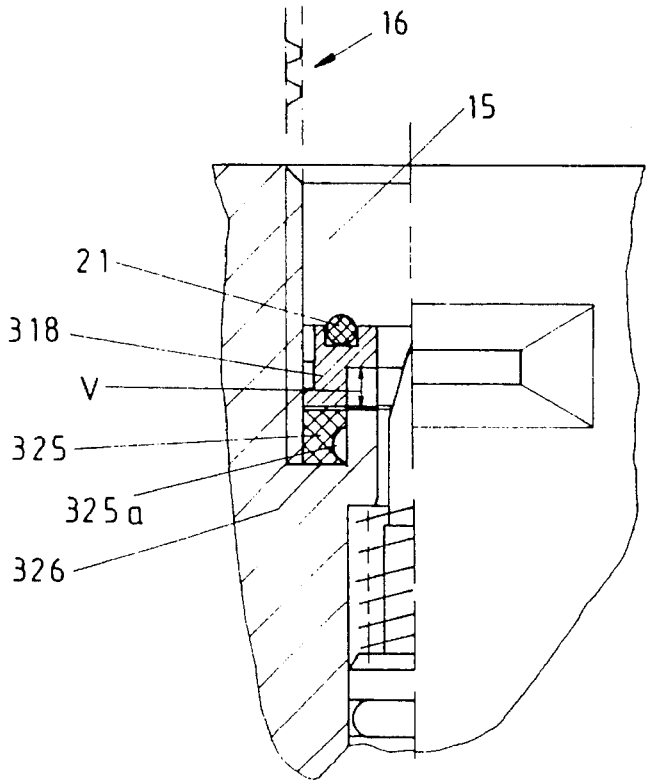
FIG. 7 shows, in a vertical partially sectioned representation, a further embodiment of the device.
Figure 8:
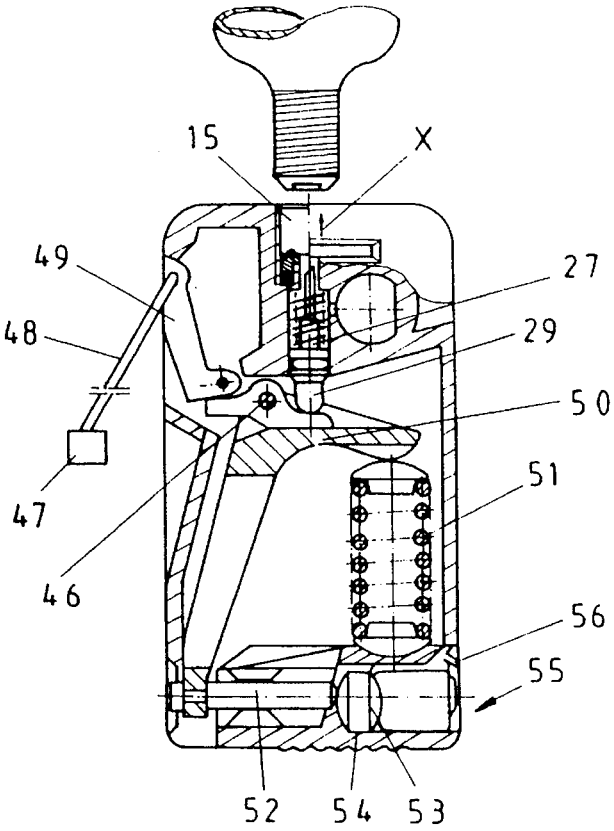
FIG. 8 shows, in a vertical partially sectioned representation, the device according to FIG. 7 in an overall view.
Figure 9:
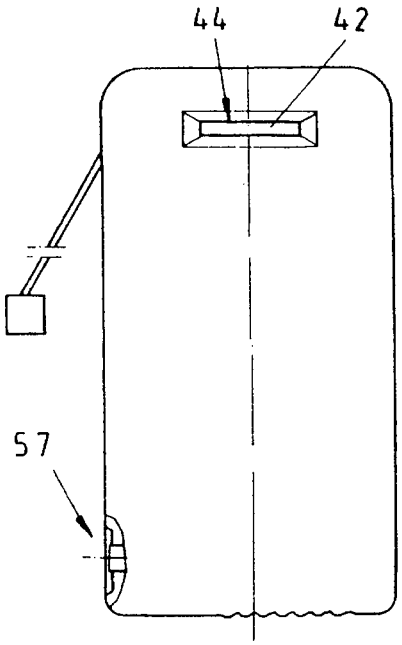
FIG. 9 shows, in a non-sectioned representation, the device according to FIG. 8.

A further embodiment is illustrated in the FIGS. 7, 8 and 9. In its basic construction this embodiment corresponds to the embodiment of FIG. 1 so that, substantially, reference is made to the description provided there. However, an essential difference consists in that, in this embodiment, in lieu of the helical spring 25, an annular spring element 325 inserted into an annular groove 326 is employed, which is comprised of rubber, caoutchouc or of some suitable plastic material, and which is provided with an internal recess 325*a* for making the necessary and desired displacement path V of the indicating part 318 possible.

Advantageously the internal thread 16 of the housing aperture 15 is constructed in the form of a tapered thread so as to produce, at first, an as low as possible screwing-in resistance so that the torque to be applied only increases appreciably when the front-end rim of the neck of the compressed gas container impinges upon the seal 121.

Provision is made in this case for the indicating part 318 to be employed within a device which can be actuated both by automatic means as well as by hand, as is schematically illustrated in its construction in FIG. 8. In this embodiment, the actuating end 29 of the opening striker 27 is actuated by means of an intermediate member 46 swivelably supported about an axis which is integral with the housing that is counterclockwise swivelable both by means of a hand lever 49 that is outwardly swivelable with the aid of a handle 47 and a traction strap 48, as well as by means of a two-armed swiveling lever 50 and which thereby, with the aid of the actuating end 29, displaces the opening striker 27 in the direction of the diaphragm 14. In this connection the swiveling lever pretensioned by a spring 51 is supported by means of a pin 52 on a so-called automatic element 53 which is firmly mounted in the housing. When water now penetrates into the housing recess 54 accommodating the automatic element 53 in the indicated slide-in casing 55, a sudden disintegration of the automatic element 53 takes place so that the pin 52 is able to move freely and the device is released. The precondition for the reliable operational sequence being, of course, that the compressed gas container 11 is screwed into the housing bore 15 in the planned manner.

That is why, in such a device, it is at once apparent to the user whether the device is in a planned optimal operative state when the end of the pin 52 issues from the housing at 57 in the form of an indicator, whereby an indication is provided that the automatic element 53 is correctly inserted and when the green coat of paint 42 becomes visible in the window 44.

Although several particular embodiments of the invention have been described in detail for purposes of illustration, various modifications of each may be made without departing from the spirit and scope of the invention. Accordingly, the invention is not to be limited, except as by the appended claims.

What is claimed is:

1. A device for the inflation of a container or a floating body of an item of lifesaving equipment with compressed gas from a compressed gas container, the device comprising:

a housing including a receiving aperture for receiving a neck of the compressed gas container;

an opening striker disposed in the housing and movable by means of a hand lever or by the force of a spring, for opening a diaphragm of the compressed gas container to release the compressed gas therefrom;

means displaceably guided within the housing, for indicating when the compressed gas container is screwed into the receiving aperture, the indicating means being displaced by the compressed gas container from an initial position; and means for supporting the indicating means, with the aid of a spring element, against a displacement from the initial position.

2. The device of claim 1, wherein the housing includes a perforation extending from an exterior surface of the housing to the indicating means, the perforation forming a viewing window which makes possible a view of the indicating means within the housing.

3. The device of claim 2, wherein the indicating means includes a casing surface having a first subsurface which, in the initial position of the indicating means, is disposed reposingly within the region of the perforation.

4. The device of claim 3, wherein the indicating means includes a second subsurface of the casing surface, the indicating means is displaceable into a terminal position, and wherein when the indicating means is in the terminal position, the second subsurface is disposed within the region of the perforation.

5. The device of any of claims 1 through 4, wherein the spring element comprises a helical spring fitted into a, relative to a longitudinal axis of the device, concentrically constructed annular groove.

6. The device of any of claims 1–4, wherein the spring element comprises a spring ring disposed in a, relative to a central longitudinal axis of the device, concentrically constructed annular groove.

7. The device of claim 6, wherein the spring element is comprised of plastic, rubber or caoutchouc.

8. The device of claim 4, wherein the perforation possesses a substantially rectangular configuration and in cross-section the perforation possesses a height in the direction of the central longitudinal axis of the device which corresponds to approximately half of a displacement path of the indicating means from its initial position to its terminal position.

9. The device of any of claims 1–4 or 8, wherein, when the compressed gas container is screwed-in, the indicating means, on a front side thereof, can be acted upon by the compressed gas container by means of a front-end rim thereof which surrounds the diaphragm, and is displaceable by at least a part of the screwing-in path of the compressed gas container in a screwing-in direction.

10. The device of any of claims 1–4 or 8, wherein, in a screwing-in operation, the indicating means can be acted upon by a ring, lug, cam or surface area of the compressed gas container, and is displaceable by at least a part of a screwing-in path of the compressed gas container in a screwing-in direction.

11. The device of any of claims 1–4 or 8, wherein the indicating means is constructed in the form of a sleeve which is guided inside the housing aperture.

12. The device of claim 9, wherein the indicating means is constructed in the form of a sleeve which is guided inside the housing aperture.

13. The device of claim 10, wherein the indicating means is constructed in the form of a sleeve which is guided inside the housing aperture.

14. The device of claim 11, wherein the indicating means possesses a perforation aperture for the passing through of the opening striker.

15. The device of claim 14, wherein, on an upper surface of the compressed gas container, a seal surrounding the perforation aperture is disposed.

* * * * *